US010964283B2

(12) United States Patent
Cho

(10) Patent No.: US 10,964,283 B2
(45) Date of Patent: Mar. 30, 2021

(54) DISPLAY DEVICE HAVING HIGH APERTURE RATIO AND LOW POWER CONSUMPTION

(71) Applicant: Samsung Display Co., Ltd., Yongin (KR)

(72) Inventor: Dong-Beom Cho, Asan-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 15/967,014

(22) Filed: Apr. 30, 2018

(65) Prior Publication Data

US 2018/0247604 A1 Aug. 30, 2018

Related U.S. Application Data

(62) Division of application No. 14/273,254, filed on May 8, 2014, now abandoned.

(30) Foreign Application Priority Data

Jan. 17, 2014 (KR) ..... 10-2014-0006135

(51) Int. Cl.
*G09G 3/36* (2006.01)

(52) U.S. Cl.
CPC ..... *G09G 3/3688* (2013.01); *G09G 3/3614* (2013.01); *G09G 2330/021* (2013.01)

(58) Field of Classification Search
None
See application file for complete search history.

(56) References Cited

U.S. PATENT DOCUMENTS

| | | | | |
|---|---|---|---|---|
| 6,552,707 | B1 | 4/2003 | Fujiyoshi | |
| 6,707,441 | B1 * | 3/2004 | Hebiguchi | G09G 3/3648 345/92 |
| 7,548,288 | B2 | 6/2009 | Kim et al. | |
| 7,808,494 | B2 | 10/2010 | Lee et al. | |
| 8,253,670 | B2 | 8/2012 | Ono | |
| 2003/0169247 | A1 | 9/2003 | Kawabe | |
| 2003/0189559 | A1 * | 10/2003 | Lee | G09G 3/3659 345/204 |
| 2006/0164350 | A1 | 7/2006 | Kim | |
| 2010/0073617 | A1 | 3/2010 | Han | |
| 2012/0026151 | A1 * | 2/2012 | Kim | G09G 3/3614 345/212 |
| 2013/0140575 | A1 | 6/2013 | Asano et al. | |
| 2015/0015623 | A1 * | 1/2015 | Yang | G09G 3/3614 345/697 |

FOREIGN PATENT DOCUMENTS

KR 1020110067227 A 6/2011

* cited by examiner

*Primary Examiner* — Amare Mengistu
*Assistant Examiner* — Sarvesh J Nadkarin
(74) *Attorney, Agent, or Firm* — Innovation Counsel LLP

(57) ABSTRACT

A display device includes a plurality of pixels arranged in a column direction and a row direction, a plurality of data lines and a data driving part configured to apply data signals to the data lines. The data lines are connected with one of the pixels of a k-th column ('k' is a natural number) and one of the pixels of a (k+1)-th column in an odd-numbered row. The data lines are connected with one of the pixels of a (k+1)-th column and one of the pixels of a (k+2)-th column in an even-numbered row. As a result, a pseudo dot inversion drive pattern may be implemented while driving the data lines in accordance with a columnar polarity inversion scheme.

13 Claims, 10 Drawing Sheets

DISPLAY DEVICE HAVING HIGH APERTURE RATIO AND LOW POWER CONSUMPTION

PRIORITY STATEMENT

This application is a divisional of U.S. patent application Ser. No. 14/273,254 filed May 8, 2014, which claims priority under 35 U.S.C. § 119 to Korean Patent Application No. 10-2014-0006135, filed on Jan. 17, 2014 in the Korean Intellectual Property Office KIPO, the contents of which application are herein incorporated by reference in their entireties.

BACKGROUND

1. Field

The present disclosure of inventive concept relates to a display device. More particularly, the present disclosure relates to a display device having a relatively high aperture ratio and relatively low power consumption.

2. Description of Related Technology

Conventionally, a liquid crystal display device (LCD device) includes an LCD panel and a driving device which electrically drives the LCD panel. The LCD panel includes a plurality of data lines and a plurality of gate lines crossing the data lines. The LCD panel further includes a plurality of pixel parts arranged as a matrix and each connected to a respective one of the data lines and a respective one of the gate lines. The driving part includes a gate driving circuit which outputs respective gate signal to the gate lines, and a data driving circuit which outputs respective data signals to the data lines.

Recently, as resolutions (e.g., pixels per square cm) of LCD devices are increased, efforts are being made for reducing the number of data driving circuits used to drive the higher number of pixels so as to realize lower mass production costs and higher driving efficiencies. More specifically, one of the efforts is that of providing a structure in which two pixels adjacent to each other share one data line. This may be referred to as a shared-DL panel structure. The shared-DL panel structure may be driven in accordance with a column inversion method or a dot inversion method (where electrical drive polarity is repeatedly inverted in each to avoid artifacts of consistently driving with a same polarity).

The column inversion method has a relatively low power consumption. However, when the column inversion method is used, the display device tends to have a relatively low aperture ratio (the percentage or ratio of subarea in the display area (DA) that outputs image forming light rays versus the subarea that is blacked out and thus does not output image forming light rays from within the DA).

The dot inversion method also has a relatively low aperture ratio. Moreover, the dot inversion method tends to have high power consumption.

It would be advantageous if aperture ratio could be increased and power consumption could be decreased in a shared-DL panel structure.

It is to be understood that this background of the technology section is intended to provide useful background for understanding the here disclosed technology and as such, the technology background section may include ideas, concepts or recognitions that were not part of what was known or appreciated by those skilled in the pertinent art prior to corresponding invention dates of subject matter disclosed herein.

SUMMARY

The present disclosure of inventive concept(s) provide a display device having a relatively high aperture ratio which is configured to be driven in accordance with a pseudo dot inversion drive pattern while having a low power consumption than a display device driven with a full dot inversion scheme.

In an exemplary embodiment, a display device includes a plurality of pixels arranged in a column direction and a row direction, a plurality of data lines and a data driving part configured to apply respective data signals to respective ones of the data lines. The data lines are connected with one of the pixels of a k-th column ('k' is a natural number) and one of the pixels of a (k+1)-th column in an odd-numbered row. The data lines are connected with one of the pixels of a (k+1)-th column and one of the pixels of a (k+2)-th column in an even-numbered row. The connection pattern is repeated to provide the aforementioned pseudo dot inversion drive pattern.

In an exemplary embodiment, the data lines diving part may apply a data signal having a first polarity to the (m+1)-th data line. The data diving part may apply a data signal having an opposed second polarity to each of an m-th data line and an (m+2)-th data line adjacent to the (m+1)-th data line during one frame.

In an exemplary embodiment, the display device may further include a plurality of gate lines connected with the pixels. An n-th gate line ('n' is a natural number) may be connected with one of the pixels of an odd-numbered column. An (n+1)-th gate line may be connected with one of the pixels of an even-numbered column.

In an exemplary embodiment, pairs of the gate lines are each disposed as a bundled pair between a respective pair of immediately adjacent pixel rows.

In an exemplary embodiment, the display device may further include a gate driving part configured to apply respective gate signals to respective ones of the gate lines.

In an exemplary embodiment, the data driving part may be adjacent to a longer side of a display panel. The gate driving part may be adjacent to a shorter side of a display panel.

In an exemplary embodiment, the pixels may include red, green and blue pixels arranged in a row direction.

In an exemplary embodiment of a display device according to the present inventive concept, the display device includes a plurality of pixels arranged in a column direction and a row direction, a plurality of data lines and a data driving part configured to apply a data signal to the data lines. The data lines being connected with one of the pixels of a (k+1)-th column ('k' is a natural number) and one of the pixels of a (k+2)-th column in a j-th row ('j' is a natural number) and a (j+1)-th row. The data lines being connected with one of the pixels of a k-th column and one of the pixels of a (k+1)-th column in a (j+2)-th row and a (j+3)-th row.

In an exemplary embodiment, the data diving part may apply a data signal having a first polarity to the (m+1)-th data line. The data diving part may apply a data signal having an opposed second polarity to each of an m-th data line and an (m+2)-th data line adjacent to the (m+1)-th data line during one frame.

In an exemplary embodiment, the display device may further include a plurality of gate lines connected with the pixels. An n-th gate line ('n' is a natural number) may be connected with one of the pixels of an odd-numbered column. An (n+1)-th gate line may be connected with one of the pixels of an even-numbered column.

In an exemplary embodiment, pairs of the gate lines are each disposed as a bundled pair between a respective pair of immediately adjacent pixel rows.

In an exemplary embodiment, the display device may further include a gate driving part configured to apply respective gate signal to respective ones of the gate lines.

In an exemplary embodiment, the data driving part may be adjacent to a longer side of a display panel. The gate driving part may be adjacent to a shorter side of a display panel.

In an exemplary embodiment, the pixels may include red, green and blue pixels arranged in a row direction.

In an exemplary embodiment of a display device according to the present inventive concept, the display device includes a plurality of pixels arranged in a column direction and a row direction, a plurality of data lines and a data driving part configured to apply a data signal to the data lines. The data lines being connected with one of the pixels of a (k+1)-th column ('k' is a natural number) and one of the pixels of a (k+2)-th column in a j-th row ('j' is a natural number), a (j+1)-th row and a (j+2)-th row. The data lines being connected with one of the pixels of a k-th column and one of the pixels of a (k+1)-th column in a (j+3)-th row, a (j+4)-th row and a (j+5)-th row.

In an exemplary embodiment, the data diving part may apply a data signal having a first polarity to the (m+1)-th data line. The data lines diving part may apply a data signal having an opposed second polarity to each of an m-th data line and an (m+2)-th data line adjacent to the (m+1)-th data line during one frame.

In an exemplary embodiment, the display device may further include a plurality of gate lines connected with the pixels. An n-th gate line ('n' is a natural number) may be connected with one of the pixels of an odd-numbered column. An (n+1)-th gate line may be connected with one of the pixels of an even-numbered column.

In an exemplary embodiment, pairs of the gate lines are each disposed as a bundled pair between a respective pair of immediately adjacent pixel rows.

In an exemplary embodiment, the display device may further include a gate driving part configured to apply respective gate signals to respective ones of the gate lines.

In an exemplary embodiment, the data driving part may be adjacent to a longer side of a display panel. The gate driving part may be adjacent to a shorter side of a display panel.

According to the present disclosure of inventive concept(s), although the data driving part is configured for a column inversion method, pseudo dot inversion drive pattern may nonetheless be implemented. Also due to a cut-outs orientation pattern, a length of a branched routing from the data lines to the pixels may be shortened. Thus, an aperture ratio and a transmissivity may be increased.

In addition, since the display device is driven by a column inversion method, the display device may have a lower power consumption than one driven in accordance with a full dot inversion scheme where drive polarity has to be changed on a row by row basis (of higher frequency) rather than on a frame by frame basis (of lower frequency and thus lower power consumption).

BRIEF DESCRIPTION OF THE DRAWINGS

The above and other features and advantages of the present disclosure of inventive concept(s) will become more apparent by describing in detail exemplary embodiments thereof with reference to the accompanying drawings, in which.

DETAILED DESCRIPTION

Hereinafter, the present disclosure of invention will be explained in detail with reference to the accompanying drawings.

Figure 1:
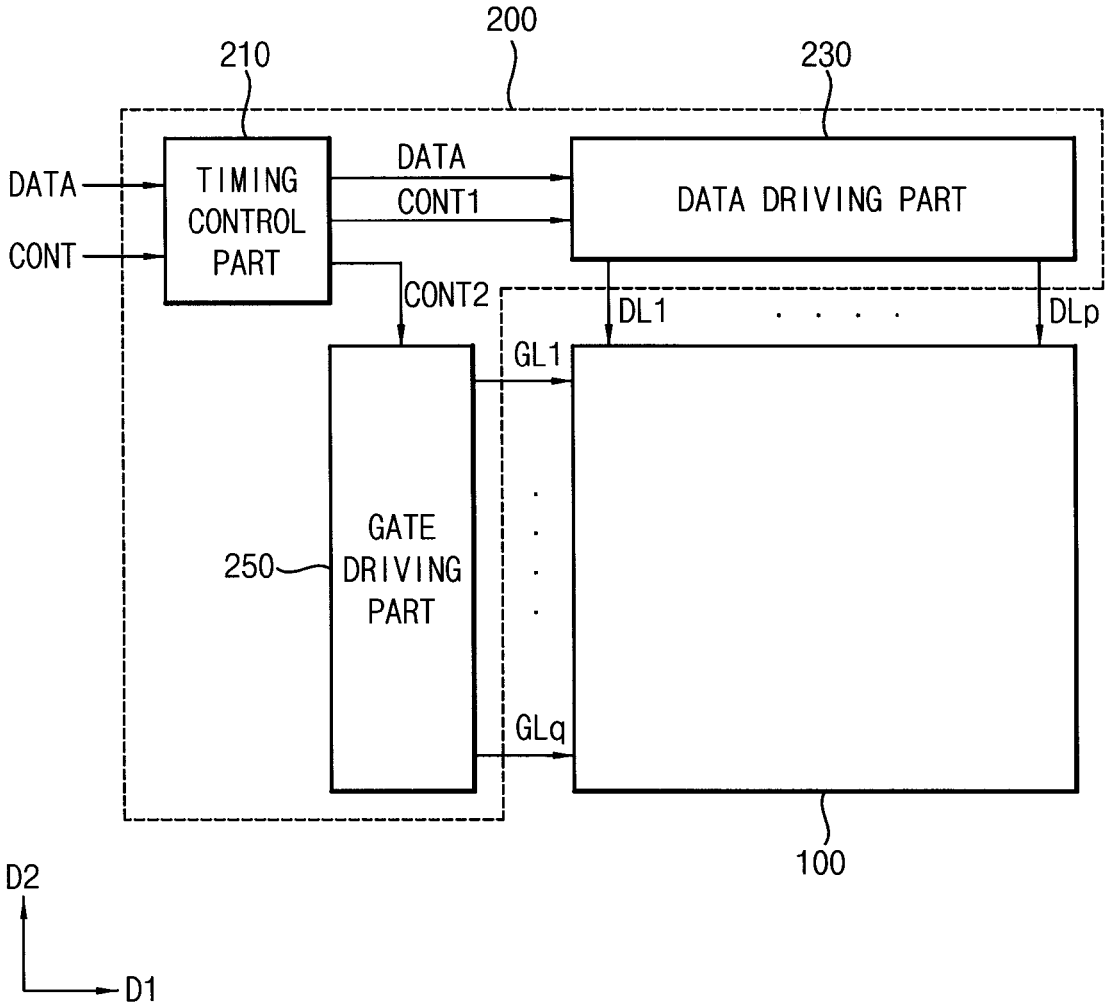
FIG. 1 is a block diagram illustrating an exemplary embodiment of a display device whose display area (DA) can be configured in accordance with the here disclosed inventive concept(s)
Figure 2:
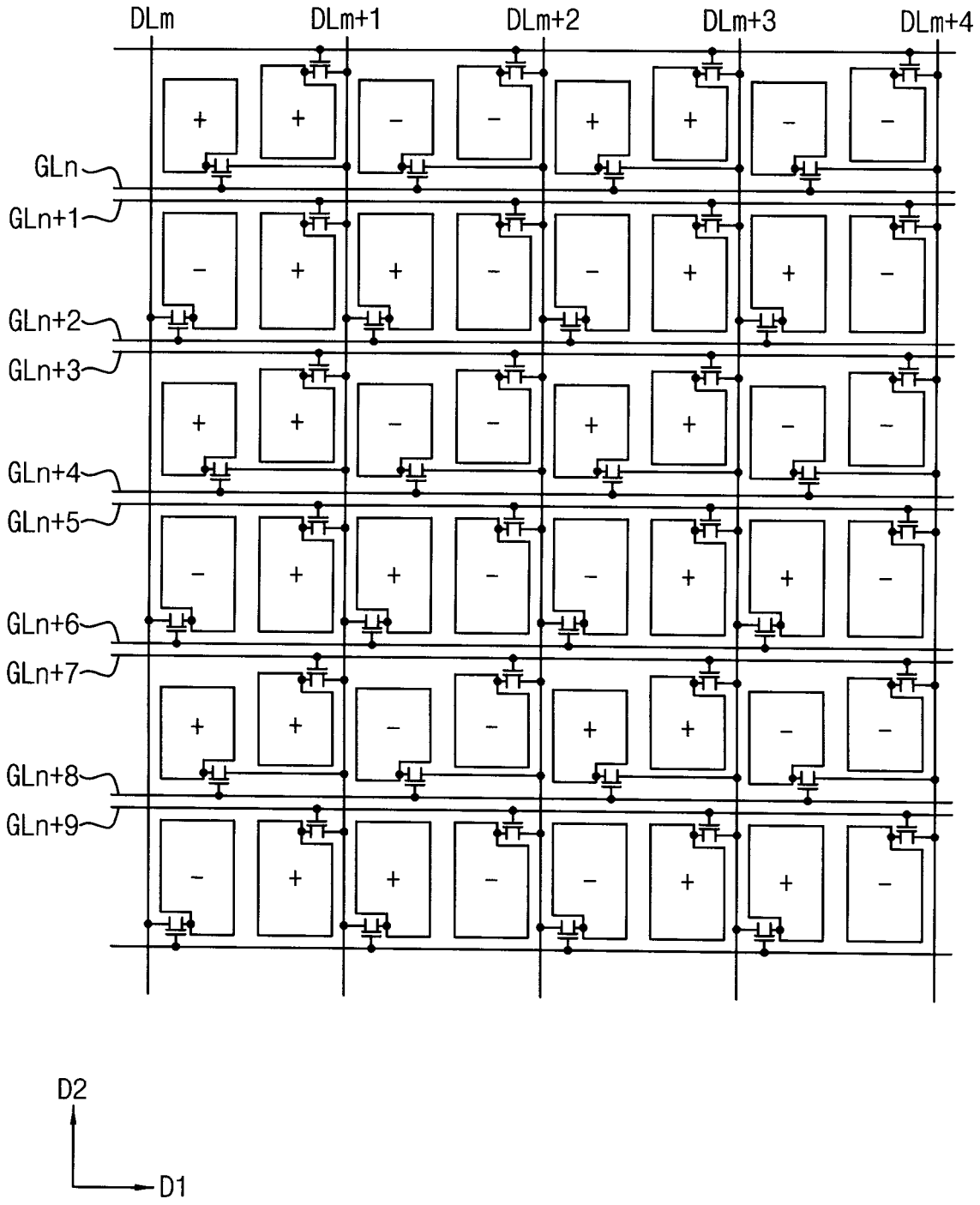
FIG. 2 is a schematic diagram illustrating a structure of a pixels matrix of a first display device in accordance with the present disclosure.

FIG. 1 is a block diagram illustrating a basic embodiment of a display device that may be structured in accordance with the present disclosure of inventive concept(s). FIG. 2 is a schematic diagram illustrating a first pixels matrix structure that may be employed in the basic device of FIG. 1 and in accordance with the present disclosure of inventive concept(s).

Referring to FIGS. 1 and 2, a display device includes a display panel 100 and a panel driving part 200 configured to electrically drive the display panel 100.

Although not specifically shown in FIG. 1, due to the number of pixel columns, the display panel 100 may have a rectangular frame shape having a longer side extended in a first direction D1 and a shorter side extended in a second direction D2 substantially crossing the first direction D1. A plurality of gate lines extend in the horizontal D1 direction and a plurality of data lines cross with the gate lines to extend in the vertical D2 direction, where both of these signal lines are formed in a display area portion of the display panel 100.

In other words, the gate lines are extended in the first direction D1 that is a longer side direction of the display panel 100 and they are arranged in spaced apart side-by-side relations when considered along the second direction D2. The data lines are extended in the second direction D2 that is a shorter side direction of the display panel 100 to be arranged as spaced apart along the first direction D1.

The display panel 100 includes a plurality of pixels which are arranged as rows extending in the first direction D1 and as columns extending the second direction D2. The pixels may include a red pixel, a green pixel and a blue pixel. Each of the colored pixels is periodically disposed across the display panel 100 so that various colored images may be formed.

The panel driving part 200 includes a timing control part 210, a data driving part 230 and a gate driving part 250.

The timing control part 210 receives a data signal DATA and a control signal CONT from an external device (not shown). The control signal CONT may include a main clock signal MCLK, a vertical synchronizing signal VSYNC, a horizontal synchronizing signal HSYNC, a data enable signal DE, etc.

The timing control part 210 generates a first control signal CONT1 for controlling a driving timing of the data driving part 230 and a second control signal CONT2 for controlling a driving timing of the gate driving part 250 by using the control signal CONT. The first control signal CONT1 may include a horizontal start signal STH, a load signal TP, a data clock signal DCLK, an inversion control signal POL, etc. The second control signal CONT2 may include a vertical start signal STV, a gate clock signal GCLK, an output enable signal OE, etc.

The data driving part 230 is disposed along at least one of the longer side portions of the display panel 100 and is configured to output respective analog data voltages to drive respective ones of the data lines. The data driving part 230 internally converts digital data signals provided from the timing control part 210 into corresponding analog voltages and outputs theses as the mentioned data voltage signals of the analog type to the respective data lines. The data driving part 230 additionally, repeatedly reverses the electrical polarity of the generated data voltages (positive or negative relative to a common voltage, Vcom) in response to a repeatedly inverted inversion control signal (POL) provided from the timing control part 210. Thus drive signals of repeatedly reversed polarities are applied to each of the data lines.

In other words, the data driving part 230 respectively applies data signals of respective polarities to respective ones of the plurality of data lines formed on the display panel 100. For example, during an N-th frame, the data driving part 230 applies a first data signal of positive polarity (+) to an (m+1)-th data line, DLm+1, and also in the same N-th frame it applies a data signal of negative polarity (−) to an adjacent m-th data line DLm and also to an additionally adjacent (m+2)-th data line DLm+2, where the latter two mentioned data lines are immediately adjacent to the initially mentioned, (m+1)-th data line DLm+1. Then, during a next successive (N+1)-th frame, the data driving part 230 applies to each of the respective data lines a respective data signal having a polarity opposite to that applied during the N-th frame. Thus, the data driving part 230 may drive the display panel 100 in accordance with a column inversion driving method. In this case, 'm' and 'N' are natural numbers.

The gate driving part 250 is disposed along at least one of the shorter side portions of the display panel 100 and is configured to sequentially output respective gate signals to respective ones of the gate lines. The gate driving part 250 generates its gate signals by using the second control signal CONT2 and predefined gate on/off voltages provided from a voltage generating part (not shown).

The gate driving part 250 sequentially applies its generated gate signals to respective ones of the plurality of gate lines formed on the display panel 100. For example, the gate driving part 250 sequentially applies row-activating gate signals to a pair of gate lines, which are, an n-th gate line GLn and an (n+1)-th gate line GLn+1 during a given horizontal scan period (1H).

While the panel driving part 200 drives the display panel 100 in accordance with an inversion method (e.g., a column inversion method that switches polarity on a frame by frame basis) the pixels are oriented and connected to the various data lines such that inversion also occurs on a row-by-row basis. More specifically, the pixels are arranged in a plurality of pixel rows and in a plurality of pixel columns. As seen in FIG. 2, some connections from next-adjacent pixels to the (m+1)-th data line DLm+1 are stretched out such that data line DLm+1 is connected with a first of the pixels of an odd-numbered first row where that first pixel is in a k-th column ('k' is a natural number, assume k is the left most column in FIG. 2) and also such that data line DLm+1 is connected with a second of the pixels in the same odd-numbered first row where that second pixel is in a (k+1)-th column. Additionally, the (m+1)-th data line DLm+1 is connected for the next below and even-numbered row with a respective first of the pixels of a (k+1)-th column and a second pixel of a (k+2)-th column (to the right of data line DLm+1 and in the subject even-numbered row). Therefore, when the subject data line DLm+1 is driven with a positive polarity data signal (+), the polarity pattern in the top row of FIG. 2, starting in the k+0 column is +,+,x (where the x pixel is driven by a different data line). At the same time, the polarity pattern in the second from top row of FIG. 2, starting in the k+0 column is x,+,+. In other words, the polarity pattern is changed on a row by row basis and also every two columns in each row. More specifically, the data lines are not provided between every column of pixels (e.g., there is no DL between the k+0 and k+1 columns) but instead; the data lines are provided between every two pixel columns (e.g., the exemplary DL(m+1) data line is disposed between the k+1 and k+2 columns of FIG. 2). In the present exemplary embodiment, the exemplary connecting structure described for the (m+1)-th data line DLm+1 is periodically repeated not only along the rest of that data line but also it is repeated; albeit in a one row off or staggered configuration for the next adjacent data line (e.g., DL(m+2)) and then again in a one row off or staggered configuration for the further next adjacent data line (e.g., DL(m+3)) and so on.

Additionally, it is to be noted from FIG. 2 that the pixel electrodes may each have a small cut-out in their generally rectangular shape for accommodating the respective pixel switching element (e.g., TFT) where the position of the cut-out alternates both vertically and horizontally as one move across each row. For example, in the top row of FIG. 2 the pattern is br, tr, bl, tl, . . . br, tr, bl, tl where br represents here, bottom right; tr represents here the top right corner of the respective pixel electrode; bl represents bottom left and tl represents top left. Then in the next from top row of FIG. 2 the pattern is shifted to be bl, tr, bl, tr, . . . bl, tr. And this pattern is repeated down the further pairs of pixel rows of exemplary FIG. 2. The cut-outs pattern is configured to minimize the branching lengths of the branches from the respective data lines that stretch out to drive adjacent and non-adjacent pixel electrodes. Although not shown, it is to be understood that a black matrix pattern that is used for blocking leakage light from between pixel-electrode-controlled areas (aperture areas) covers the gate lines and the data line extensions to next adjacent column and the TFT's disposed in the respective pixel electrode cut-outs. Therefore, the described cut-out patterns also describe a corresponding pattern for the associated black matrix (not shown).

The gate lines are extended in the first direction D1 that is a longer side direction of the display panel 100 so as to be arranged spaced apart from one another in the second direction D2. A respective pair of gate lines may be disposed between every pair of pixel rows. For example, an n-th gate line GLn and a (n+1)-th gate line GLn+1 are both disposed between the illustrated top and next to top rows of pixels in FIG. 2. The n-th gate line GLn ('n' is a natural number) is connected with pixels of the top row and in odd-numbered columns while the (n+1)-th gate line GLn+1 is connected with pixels of the second from top row and in even-numbered columns.

In the present exemplary embodiment, a connecting structure of the n-th gate line GLn and the (n+1)-th gate line GLn+1 is periodically repeated for the reminder of the gate line pairs (e.g., GLn+2 and GLn+3).

The data lines are extended in the second direction D2 that is a shorter side direction of the display panel 100 to be arranged spaced apart from one another in the first direction D1. The data lines are disposed in not every one pixel column but every two pixel columns. Although not shown, a plurality of common lines (providing the Vcom voltage) may be disposed between the pixels in which the data lines are not disposed. The common lines may be extended in the second direction D2 that is a shorter side direction of the display panel 100 to be arranged in the first direction D1.

Figure 3:
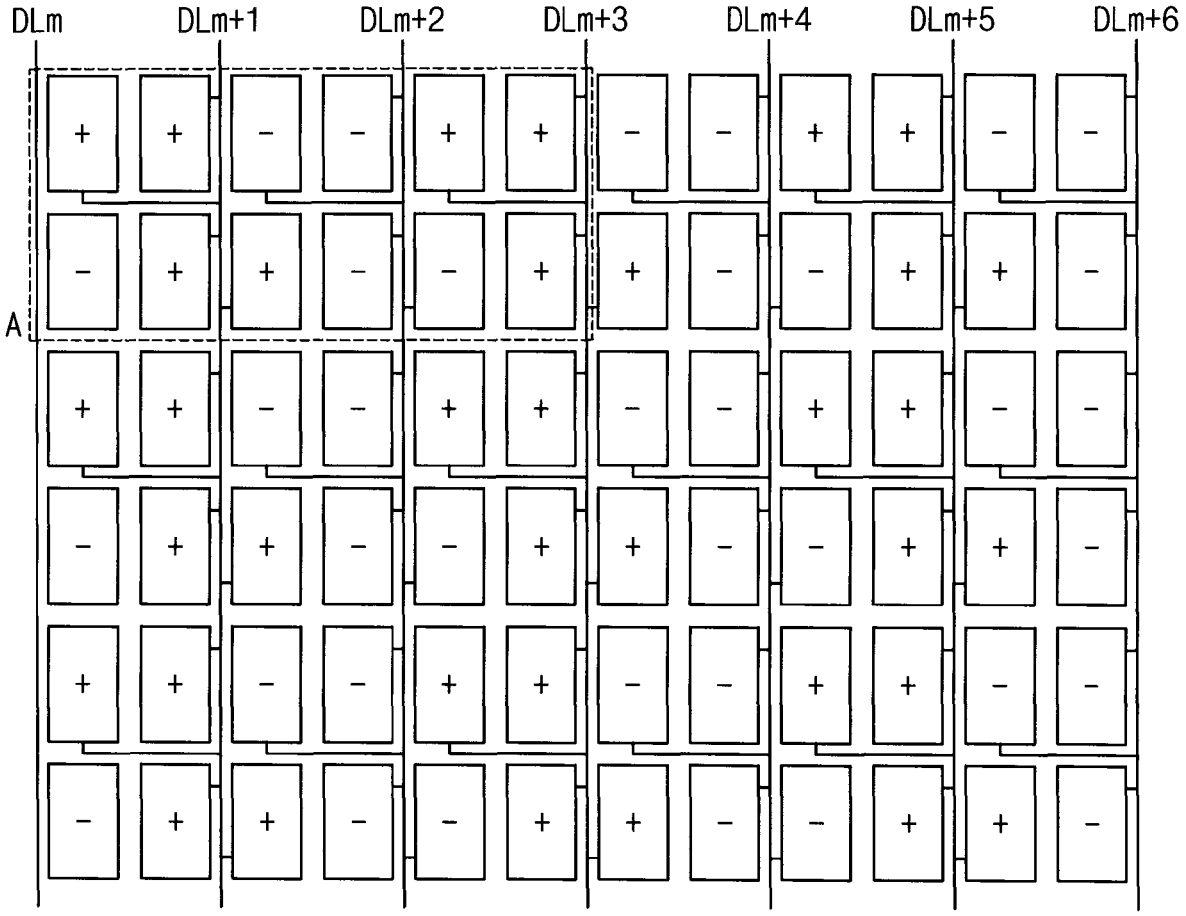
FIG. 3 is a schematic diagram illustrating a polarity inversion method usable for the pixels of the display device of FIG. 2 when in an N-th frame.

FIG. 3 shows the same polarity inversion scheme as that of FIG. 2 but in a more schematic way, where the illustrated polarity inversion pattern is understood to be for an N-th frame among a succession of image frames (e.g., (N−1), N, (N+1), . . . ) that are displayed in accordance with the present disclosure of inventive concept(s).

Referring to FIG. 3, the display panel 100 according to the inventive concept includes a plurality of pixels which are arranged in the first direction D1 and the second direction D2 crossing the first direction D1. The pixels may include a red pixel, a green pixel and a blue pixel. Each of the pixels may be periodically disposed on the display panel 100.

The data lines and the common lines (not shown) are disposed alternately between the pixel columns. The data lines are extended in the second direction D2 that is a shorter side direction of the display panel 100 to be arranged in the first direction D1. The data lines are disposed in not every one pixel column but every two pixel columns. Common lines may be optionally disposed between the pixel columns in which the data lines are not disposed. Thus such common lines are disposed in not every one pixel column but every two pixel columns. The common lines are extended in the second direction D2 that is a shorter side direction of the display panel 100 to be arranged in the first direction D1. The common lines may be paralleled with the data lines.

A (m+1)-th data line DLm+1 is connected with one of the pixels of a k-th column ('k' is a natural number) and one of the pixels of a (k+1)-th column in an odd-numbered row, and connected with one of the pixels of a (k+1)-th column and one of the pixels of a (k+2)-th column in an even-numbered row. The data lines are disposed in not every one pixel column but every two pixel columns. In the present exemplary embodiment, a connecting structure of the (m+1)-th data line DLm+1 of a portion "A" is periodically repeated across the rest of the display area (DA).

The data driving part (230 of FIG. 1) respectively applies data signals to a plurality of data lines formed on the display panel 100. For example, during the N-th frame, the data driving part 230 applies a data signal of a positive polarity (+) to an (m+1)-th data line DLm+1, and applies a data signal of a negative polarity (−) to an m-th data line DLm and an (m+2)-th data line DLm+2 adjacent to the (m+1)-th data line DLm+1, respectively.

Accordingly, a data voltage having different polarities such as in a sequence of "+, −, +, −, +, −" is applied to an odd-numbered column, and a data voltage having different polarities such as in a sequence of "+, +, +, +, +, +" or "−, −, −, −, −, −" is applied to an even-numbered row, and a data voltage having different polarities such as in a sequence of "+, +, −, −,+, +, −, −" is applied to an pixel row.

Figure 4:
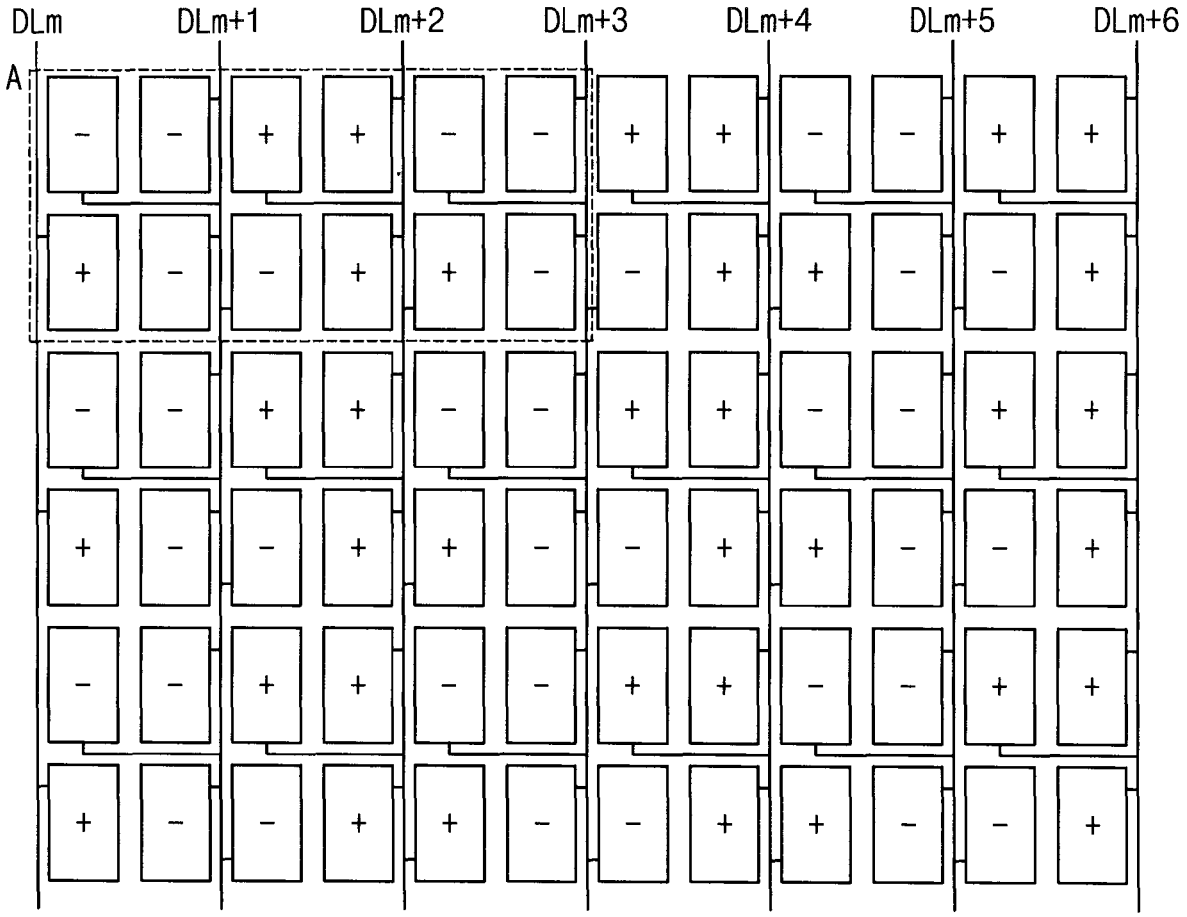
FIG. 4 is a schematic diagram illustrating the polarity inversion method of FIG. 3 but when in an (N+1) frame.

FIG. 4 is a schematic diagram illustrating an inversion of a pixel of a display device in an (N+1) frame according to the inventive concept(s).

Referring to FIG. 4, the display panel 100 according to the inventive concept includes a plurality of pixels which are arranged in the first direction D1 and the second direction D2 crossing the first direction D1. The pixels may include a red pixel, a green pixel and a blue pixel. Each of the pixels may be periodically disposed on the display panel 100.

The data lines and the common lines (not shown) are disposed alternately between the pixel columns. The data lines are extended in the second direction D2 that is a shorter side direction of the display panel 100 to be arranged in the first direction D1. The data lines are disposed in not every one pixel column but every two pixel columns. The common lines are disposed between the pixel columns in which the data lines are not disposed. The common lines are disposed in not every one pixel column but every two pixel columns. The common lines are extended in the second direction D2 that is a shorter side direction of the display panel 100 to be arranged in the first direction D1. The common lines may be paralleled with the data lines.

A (m+1)-th data line DLm+1 is connected with one of the pixels of a k-th column ('k' is a natural number) and one of the pixels of a (k+1)-th column in an odd-numbered row, and connected with one of the pixels of a (k+1)-th column and one of the pixels of a (k+2)-th column in an even-numbered row. The data lines are disposed in not every one pixel column but every two pixel columns. In the present exemplary embodiment, a connecting structure of the (m+1)-th data line DLm+1 of a portion "A" is periodically repeated.

The data driving part (230 of FIG. 1) respectively applies data signals to a plurality of data lines formed on the display panel 100. For example, during an N-th frame, the data driving part 230 applies a data signal of a negative polarity (−) to an (m+1)-th data line DLm+1, and applies a data signal of a positive polarity (+) to an m-th data line DLm and an (m+2)-th data line DLm+2 adjacent to the (m+1)-th data line DLm+1, respectively.

Accordingly, a data voltage having different polarities such as in a sequence of "+, −, +, −, +, −" is applied to an odd-numbered column, and a data voltage having different polarities such as in a sequence of "+, +, +, +, +, +" or "−, −, −, −, −, −" is applied to an even-numbered row, and a data voltage having different polarities such as in a sequence of "+, +, −, −, +, +, −, −" is applied to an pixel row.

Figure 5:
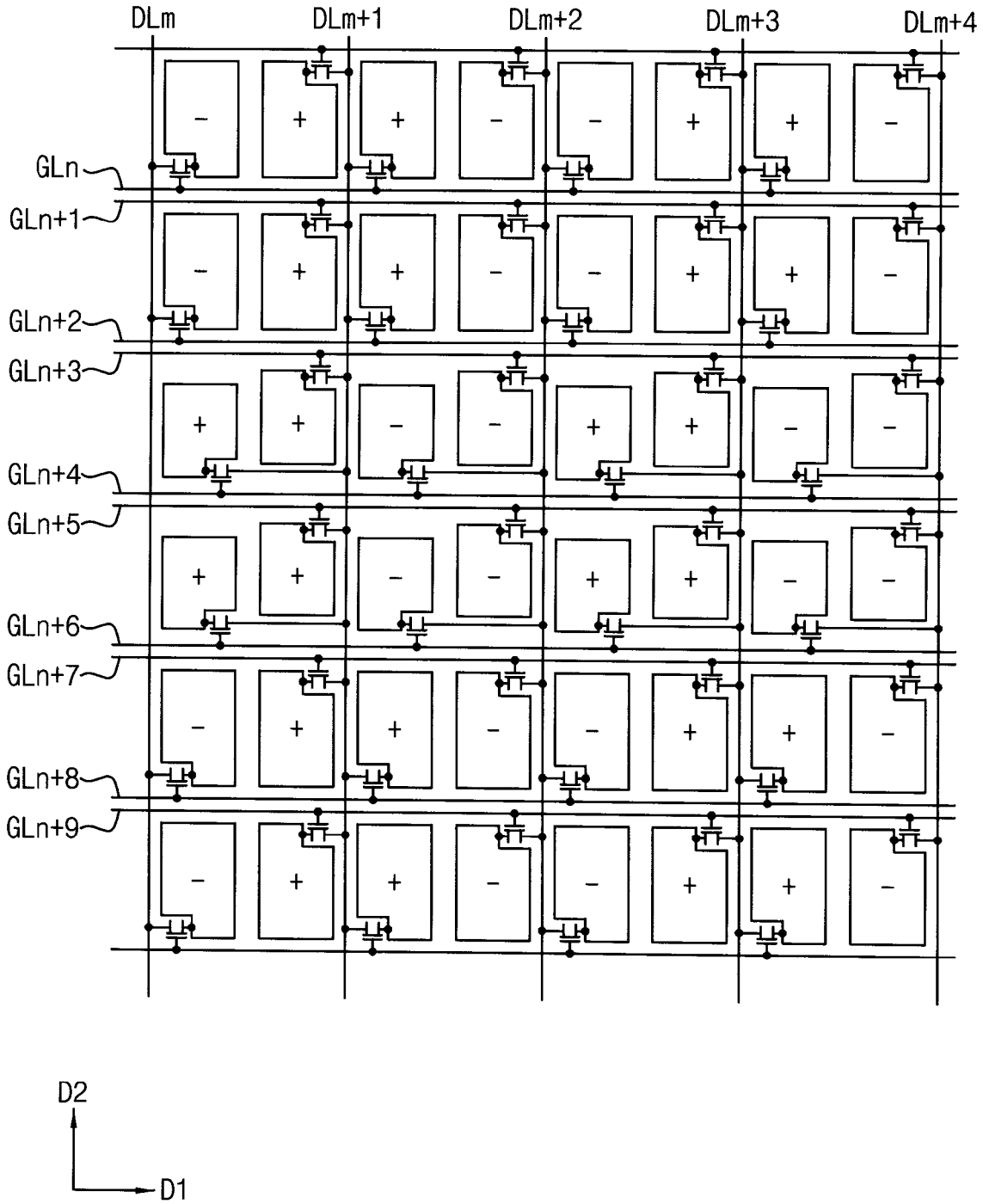
FIG. 5 is a schematic diagram illustrating a structure of a pixels matrix of a second display device in accordance with the present disclosure.

FIG. 5 is a schematic diagram illustrating another patterned structure for the pixels of a display device in accordance with the present disclosure.

Referring to FIGS. 1 and 5, the exemplary display device includes a display panel 100 and a panel driving part 200 configured to drive the display panel 100, where the pattern of FIG. 5 is similar to that of FIG. 2 except that repetition occurs every 4 rows instead of every two rows.

More specifically, the display panel 100 of this next embodiment may have a frame shape having a longer side extended in a first direction D1 and a shorter side extended in a second direction D2 substantially crossing the first direction D1. A plurality of gate lines and a plurality of data lines crossing the gate lines are formed on the display panel 100.

The gate lines are extended in the first direction D1 that is a longer side direction of the display panel 100 to be arranged in the second direction D2. The data lines are extended in the second direction D2 that is a shorter side direction of the display panel 100 to be arranged in the first direction D1.

The display panel 100 includes a plurality of pixels which are arranged in the first direction D1 and the second direction D2 crossing the first direction D1. The pixels may include a red pixel, a green pixel and a blue pixel. Each of the pixels is periodically disposed on the display panel 100.

The panel driving part 200 includes a timing control part 210, a data driving part 230 and a gate driving part 250.

The timing control part 210 receives a data signal DATA and a control signal CONT from an external device (not shown). The control signal CONT may include a main clock signal MCLK, a vertical synchronizing signal VSYNC, a horizontal synchronizing signal HSYNC, a data enable signal DE, etc.

The timing control part 210 generates a first control signal CONT1 for controlling a driving timing of the data driving part 230 and a second control signal CONT2 for controlling a driving timing of the gate driving part 250 by using the control signal CONT. The first control signal CONT1 may include a horizontal start signal STH, a load signal TP, a data clock signal DCLK, an inversion signal POL, etc. The second control signal CONT2 may include a vertical start signal STV, a gate clock signal GCLK, an output enable signal OE, etc.

The data driving part 230 is disposed at a longer side portion of the display panel 100 to output a data voltage to the data lines. The data driving part 230 converts a digital data signal provided from the timing control part 210 into a data voltage of an analog type, and outputs the data voltage of the analog type to the data lines. The data driving part 230 inverses the polarity of the data voltage in response to an inversion signal provided from the timing control part 210 to output the data lines.

The data driving part 230 respectively applies data signals to a plurality of data lines formed on the display panel 100. For example, during an N-th frame, the data driving part 230 applies a data signal of a positive polarity (+) to an (m+1)-th data line DLm+1, and applies a data signal of a negative polarity (−) to an m-th data line DLm and to an (m+2)-th data line DLm+2 adjacent to the (m+1)-th data line DLm+1, respectively. Then, during an (N+1)-th frame, the data driving part 230 applies a data signal having a polarity opposite to that of a data signal applied during the N-th frame. Thus, the data driving part 230 may drive the display panel 100 in a column inversion driving method. In this case, 'm' and 'N' are natural numbers.

The gate driving part 250 is disposed at a shorter side portion of the display panel 100 to sequentially output a gate signal to the gate lines. The gate driving part 250 generates a gate signal by using the second control signal CONT2 and gate on/off voltages provided from a voltage generating part (not shown).

The gate driving part 250 sequentially applies gate signals to a plurality of gate lines formed on the display panel 100. For example, the gate driving part 250 sequentially applies gate signals to a pair of gate lines, which are, an n-th gate line GLn and an (n+1)-th gate line GLn+1 during a horizontal period (1H).

The panel driving part 200 drives the display panel 100 in accordance with an inversion method. The pixels are arranged in a plurality of pixel rows and in a plurality of pixel columns. The (m+1)-th data line DLm+1 is directly connected with one of the pixels of a (k+1)-th column ('k' is a natural number) and one of the pixels of a (k+2)-th column and is not directly connected with one of a pixels of a k-th column in a j-th row ('j' is a natural number) and a (j+1)-th row, and directly connected with one of the pixels of a k-th column and one of the pixels of a (k+1)-th column and is not directly connected with one of a pixels of a (k+2)-th column in a (j+2)-th row and a (j+3)-th row. Herein, "directly connected with" means that one electronic component is connected with another electronic component without any other electronic component interposed between the one electronic component and the another electronic component except a conductor. The data lines are not disposed in every pixel column but rather disposed in every two pixel columns. In the present exemplary embodiment, a connecting structure of the (m+1)-th data line DLm+1 is periodically repeated.

The gate lines are extended in the first direction D1 that is a longer side direction of the display panel 100 to be arranged in the second direction D2. A pair of gate lines may be disposed in every the pixel rows. For example, an n-th gate line GLn and a (n+1)-th gate line GLn+1 are disposed between the pixel rows together. The n-th gate line GLn ('n' is a natural number) is connected with one of the pixels of an odd-numbered column, and the (n+1)-th gate line GLn+1 is connected with one of the pixels of an even-numbered column.

In the present exemplary embodiment, a connecting structure of the n-th gate line GLn and the (n+1)-th gate line GLn+1 is periodically repeated.

The data lines are extended in the second direction D2 that is a shorter side direction of the display panel 100 to be arranged in the first direction D1. The data lines are disposed in not every one pixel column but every two pixel columns. A plurality of common lines (not shown) may be disposed between the pixels in which the data lines are not disposed. The common lines may be extended in the second direction D2 that is a shorter side direction of the display panel 100 to be arranged in the first direction D1.

Figure 6:
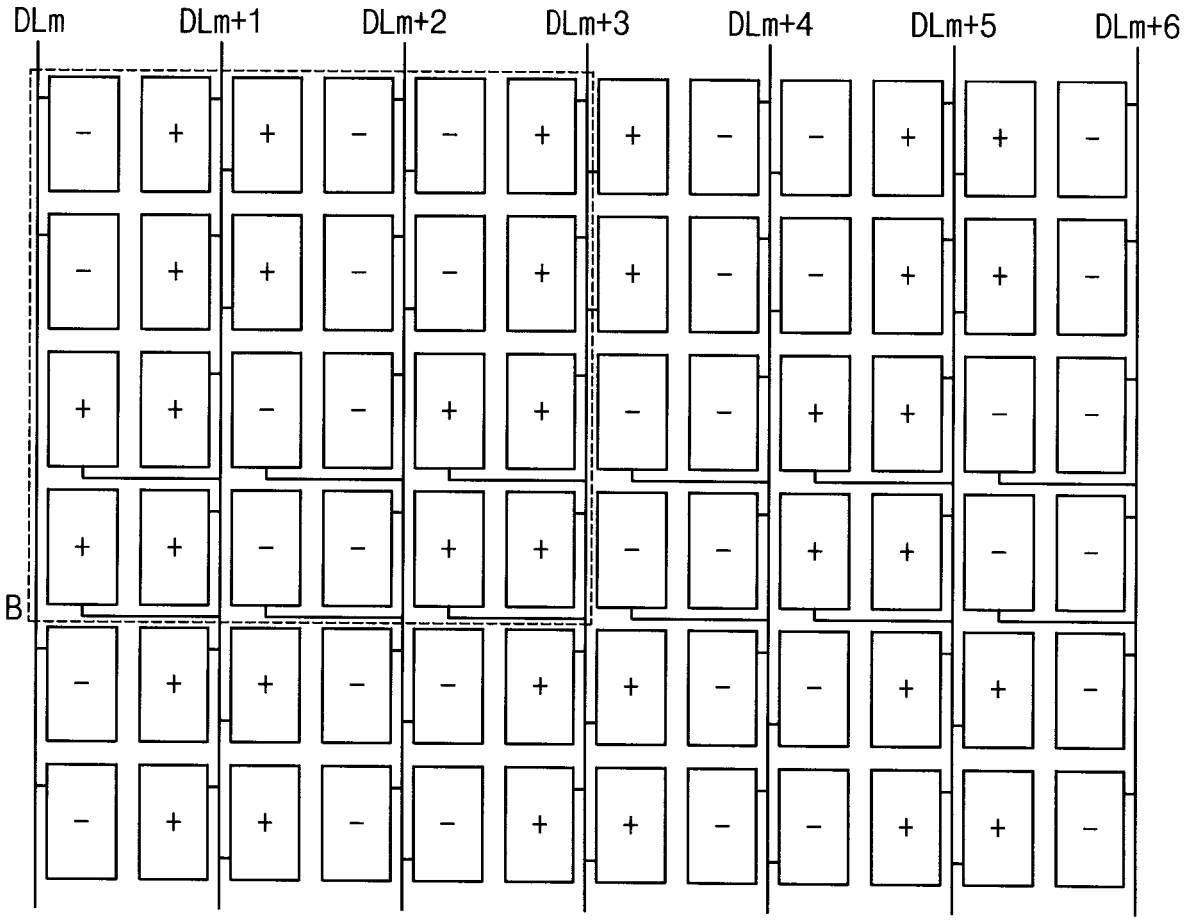
FIG. 6 is a schematic diagram illustrating a polarity inversion method usable for the pixels of the display device of FIG. 5 when in an N-th frame.

FIG. 6 is a schematic diagram illustrating an inversion pattern applied to the pixels of the display device of FIG. 5 in an N-th frame in accordance with the present disclosure.

Referring to FIG. 6, the display panel 100 according to the inventive concept includes a plurality of pixels which are arranged in the first direction D1 and the second direction D2 crossing the first direction D1. The pixels may include a red pixel, a green pixel and a blue pixel. Each of the pixels may be periodically disposed on the display panel 100.

The data lines and the common lines (not shown) are disposed alternately between the pixel columns. The data lines are extended in the second direction D2 that is a shorter side direction of the display panel 100 to be arranged in the first direction D1. The data lines are disposed in not every one pixel column but every two pixel columns. The common lines are disposed between the pixel columns in which the data lines are not disposed. The common lines are disposed in not every one pixel column but every two pixel columns. The common lines are extended in the second direction D2 that is a shorter side direction of the display panel 100 to be arranged in the first direction D1. The common lines may be paralleled with the data lines.

The (m+1)-th data line DLm+1 is connected with one of the pixels of a (k+1)-th column ('k' is a natural number) and one of the pixels of a (k+2)-th column in a j-th row ('j' is a natural number) and a (j+1)-th row, and connected with one of the pixels of a k-th column and one of the pixels of a (k+1)-th column in a (j+2)-th row and a (j+3)-th row. In the present exemplary embodiment, a connecting structure of the (m+1)-th data line DLm+1 of a portion "B" (which is four rows deep and 6 columns wide) is periodically repeated.

The data driving part (230 of FIG. 1) respectively applies data signals to a plurality of data lines formed on the display panel 100. For example, during an N-th frame, the data driving part 230 applies a data signal of a positive polarity (+) to an (m+1)-th data line DLm+1, and applies a data signal of a negative polarity (−) to an m-th data line DLm and an (m+2)-th data line DLm+2 adjacent to the (m+1)-th data line DLm+1, respectively.

Accordingly, a data voltage having different polarities such as in a sequence of "+, +, −, −, +, +" is applied to an odd-numbered column, and a data voltage having different polarities such as in a sequence of "+, +, +, +, +, +" or "−, −, −, −, −, −" is applied to an even-numbered row, and a data voltage having different polarities such as in a sequence of "+, +, −, −, +, +, −, −" is applied to an pixel row.

Figure 7:
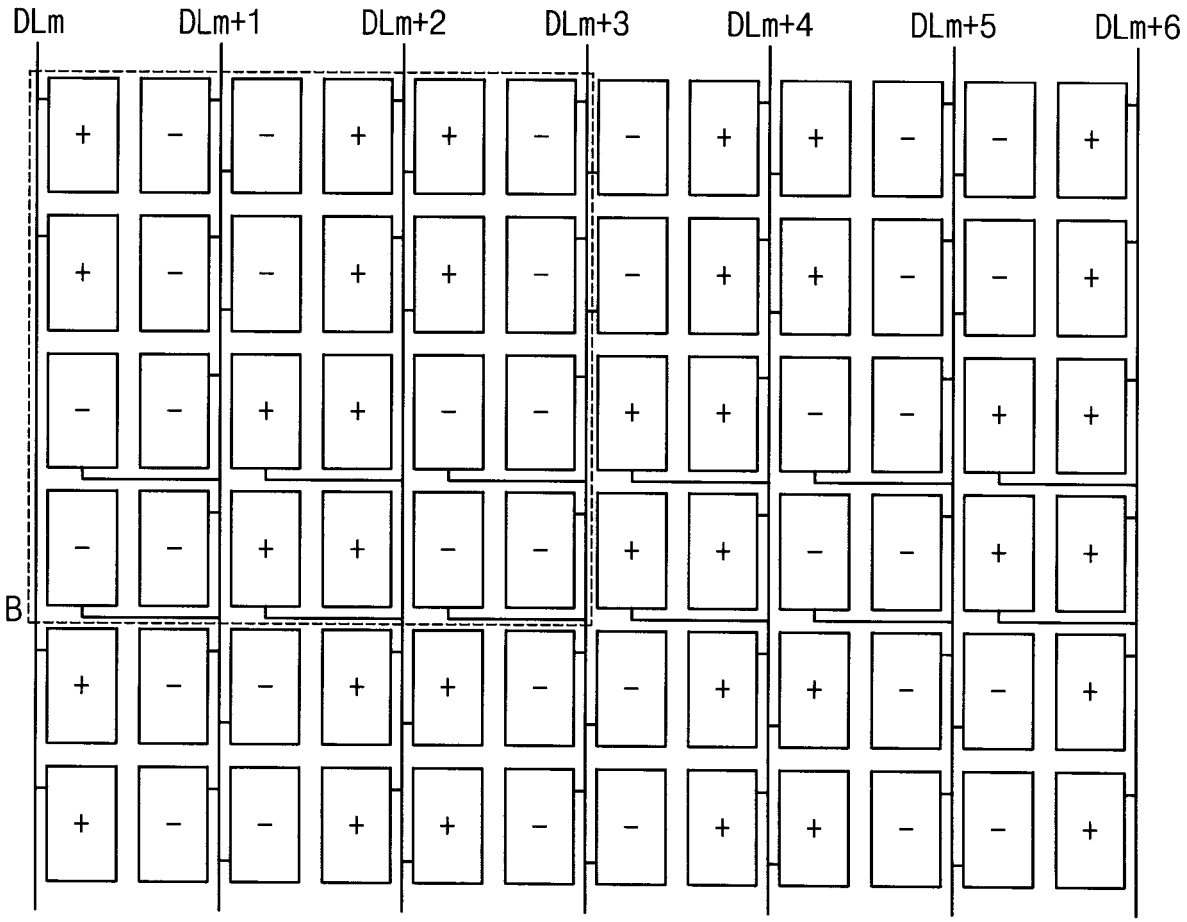
FIG. 7 is a schematic diagram illustrating the polarity inversion method of FIG. 6 but when in an (N+1) frame.

FIG. 7 is a schematic diagram illustrating the inversion pattern for the (N+1)-th frame according to the embodiment of FIGS. 5-6.

Referring to FIG. 7, the display panel 100 according to the inventive concept includes a plurality of pixels which are arranged in the first direction D1 and the second direction D2 crossing the first direction D1. The pixels may include a red pixel, a green pixel and a blue pixel. Each of the pixels may be periodically disposed on the display panel 100.

The data lines and the common lines (not shown) are disposed alternately between the pixel columns. The data lines are extended in the second direction D2 that is a shorter side direction of the display panel 100 to be arranged in the first direction D1. The data lines are disposed in not every one pixel column but every two pixel columns. The common lines are disposed between the pixel columns in which the data lines are not disposed. The common lines are disposed in not every one pixel column but every two pixel columns. The common lines are extended in the second direction D2 that is a shorter side direction of the display panel 100 to be arranged in the first direction D1. The common lines may be paralleled with the data lines.

The (m+1)-th data line DLm+1 is connected with one of the pixels of a (k+1)-th column ('k' is a natural number) and one of the pixels of a (k+2)-th column in a j-th row ('j' is a natural number) and a (j+1)-th row, and connected with one of the pixels of a k-th column and one of the pixels of a (k+1)-th column in a (j+2)-th row and a (j+3)-th row. In the present exemplary embodiment, a connecting structure of the (m+1)-th data line DLm+1 of a portion "B" is periodically repeated.

The data driving part (230 of FIG. 1) respectively applies data signals to a plurality of data lines formed on the display panel 100. For example, during an N-th frame, the data driving part 230 applies a data signal of a negative polarity (−) to an (m+1)-th data line DLm+1, and applies a data signal of a positive polarity (+) to an m-th data line DLm and an (m+2)-th data line DLm+2 adjacent to the (m+1)-th data line DLm+1, respectively.

Accordingly, a data voltage having different polarities such as in a sequence of "+, +, −, −, +, +" is applied to an odd-numbered column, and a data voltage having different polarities such as in a sequence of "+, +, +, +, +, +" or "−, −, −, −, −, −" is applied to an even-numbered row, and a data voltage having different polarities such as in a sequence of "+, +, −, −, +, +, −, −" is applied to an pixel row.

Figure 8:
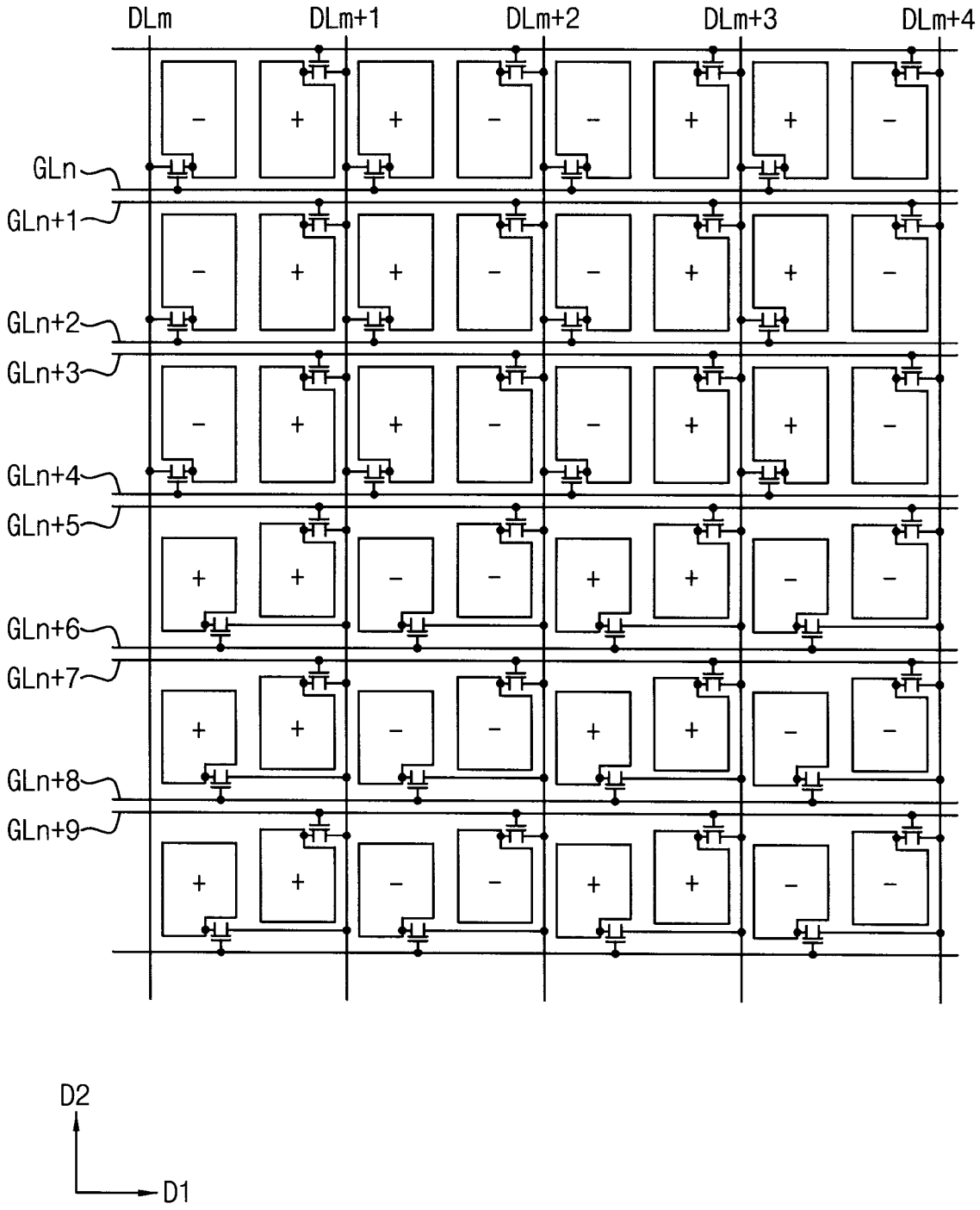
FIG. 8 is a schematic diagram illustrating a pixels matrix of a third display device in accordance with the present disclosure.

FIG. 8 is a schematic diagram illustrating yet another structure of a pixel pattern in accordance with the disclosure where the repeat pattern (C of FIG. 9) is 6 rows deep and 6 rows wide.

Referring to FIGS. 1 and 8, a display device includes a display panel 100 and a panel driving part 200 configured to drive the display panel 100.

The display panel 100 may have a frame shape having a longer side extended in a first direction D1 and a shorter side extended in a second direction D2 substantially crossing the first direction D1. A plurality of gate lines and a plurality of data lines crossing the gate lines are formed on the display panel 100.

The gate lines are extended in the first direction D1 that is a longer side direction of the display panel 100 to be arranged in the second direction D2. The data lines are extended in the second direction D2 that is a shorter side direction of the display panel 100 to be arranged in the first direction D1.

The display panel 100 includes a plurality of pixels which are arranged in the first direction D1 and the second direction D2 crossing the first direction D1. The pixels may include a red pixel, a green pixel and a blue pixel. Each of the pixels is periodically disposed on the display panel 100.

The panel driving part 200 includes a timing control part 210, a data driving part 230 and a gate driving part 250.

The timing control part 210 receives a data signal DATA and a control signal CONT from an external device (not shown). The control signal CONT may include a main clock signal MCLK, a vertical synchronizing signal VSYNC, a horizontal synchronizing signal HSYNC, a data enable signal DE, etc.

The timing control part 210 generates a first control signal CONT1 for controlling a driving timing of the data driving part 230 and a second control signal CONT2 for controlling a driving timing of the gate driving part 250 by using the control signal CONT. The first control signal CONT1 may include a horizontal start signal STH, a load signal TP, a data clock signal DCLK, an inversion signal POL, etc. The second control signal CONT2 may include a vertical start signal STV, a gate clock signal GCLK, an output enable signal OE, etc.

The data driving part 230 is disposed at a longer side portion of the display panel 100 to output a data voltage to the data lines. The data driving part 230 converts a digital data signal provided from the timing control part 210 into a data voltage of an analog type, and outputs the data voltage of the analog type to the data lines. The data driving part 230 inverses the polarity of the data voltage in response to an inversion signal provided from the timing control part 210 to output the data lines.

The data driving part 230 respectively applies data signals to a plurality of data lines formed on the display panel 100. For example, during an N-th frame, the data driving part 230 applies a data signal of a positive polarity (+) to an (m+1)-th data line DLm+1, and applies a data signal of a negative polarity (−) to an m-th data line DLm and an (m+2)-th data line DLm+2 adjacent to the (m+1)-th data line DLm+1, respectively. Then, during an (N+1)-th frame, the data driving part 230 applies a data signal having a polarity opposite to that of a data signal applied during the N-th frame. Thus, the data driving part 230 may drive the display panel 100 in a column inversion driving method. In this case, 'm' and 'N' are natural numbers.

The gate driving part 250 is disposed at a shorter side portion of the display panel 100 to sequentially output a gate signal to the gate lines. The gate driving part 250 generates a gate signal by using the second control signal CONT2 and gate on/off voltages provided from a voltage generating part (not shown).

The gate driving part 250 sequentially applies gate signals to a plurality of gate lines formed on the display panel 100. For example, the gate driving part 250 sequentially applies gate signals to a pair of gate lines, which are, an n-th gate line GLn and an (n+1)-th gate line GLn+1 during a horizontal period (1H).

The panel driving part 200 drives the display panel 100 in accordance with an inversion method. The pixels are arranged in a plurality of pixel rows and in a plurality of pixel columns. The (m+1)-th data line DLm+1 is directly connected with one of the pixels of a (k+1)-th column ('k' is a natural number) and one of the pixels of a (k+2)-th column and is not directly connected with one of a pixels of a k-th column in a j-th row ('j' is a natural number), a (j+1)-th row and a (j+2)-th row, and directly connected with one of the pixels of a k-th column and one of the pixels of a (k+1)-th column and is not directly connected with one of a pixels of a (k+2)-th column in a (j+3)-th row, a (j+4)-th row and a (j+5)-th row. Herein, "directly connected with" means that one electronic component is connected with another electronic component without any other electronic component interposed between the one electronic component and the electronic another component except a conductor. The data lines are not disposed in every pixel column but disposed in every two pixel columns. In the present exemplary embodiment, a connecting structure of the (m+1)-th data line DLm+1 is periodically repeated.

The gate lines are extended in the first direction D1 that is a longer side direction of the display panel 100 to be arranged in the second direction D2. A pair of gate lines may be disposed in every the pixel rows. For example, an n-th gate line GLn and a (n+1)-th gate line GLn+1 are disposed between the pixel rows together. The n-th gate line GLn ('n' is a natural number) is connected with one of the pixels of an odd-numbered column, and the (n+1)-th gate line GLn+1 is connected with one of the pixels of an even-numbered column.

In the present exemplary embodiment, a connecting structure of the n-th gate line GLn and the (n+1)-th gate line GLn+1 is periodically repeated.

The data lines are extended in the second direction D2 that is a shorter side direction of the display panel 100 to be arranged in the first direction D1. The data lines are disposed in not every one pixel column but every two pixel columns. A plurality of common lines (not shown) may be disposed between the pixels in which the data lines are not disposed. The common lines may be extended in the second direction D2 that is a shorter side direction of the display panel 100 to be arranged in the first direction D1.

Figure 9:
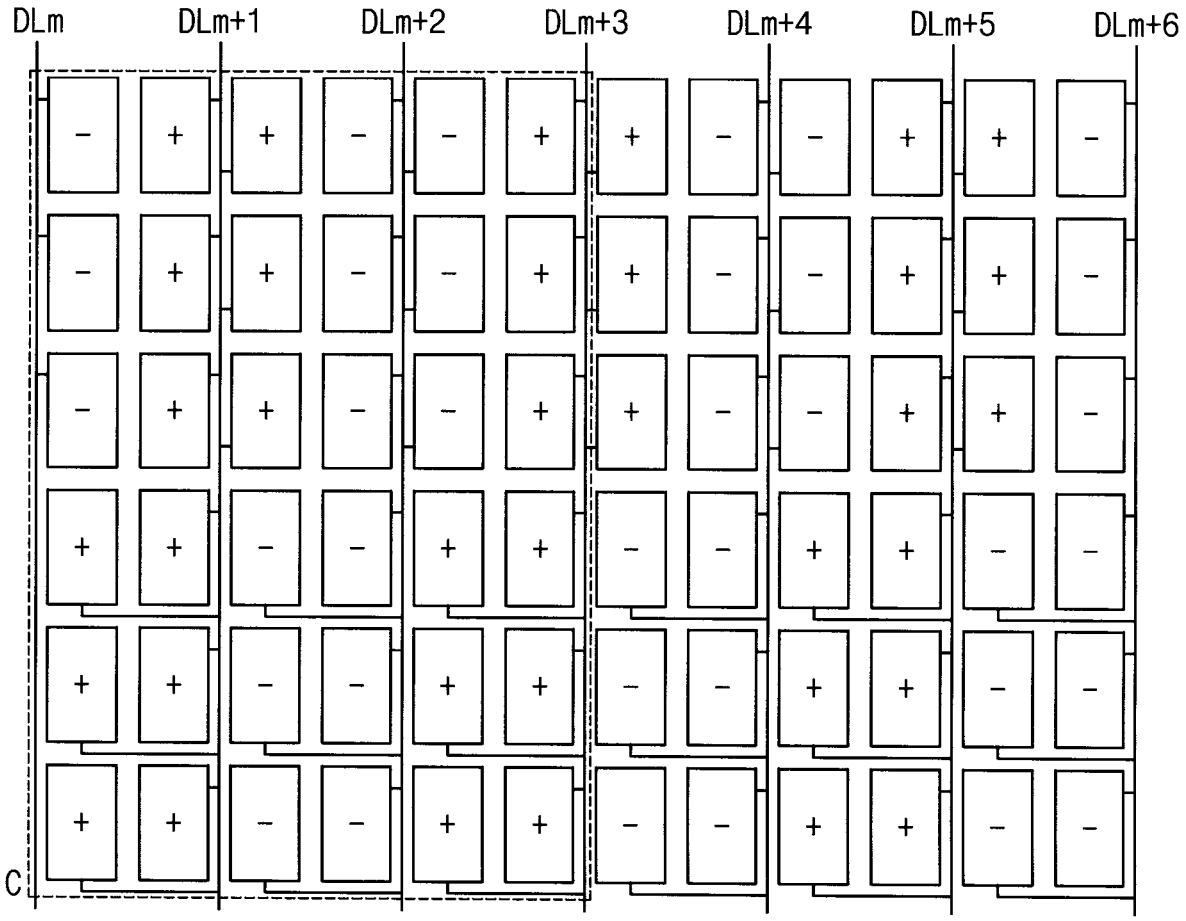
FIG. 9 is a schematic diagram illustrating a polarity inversion method usable for the pixels of the display device of FIG. 8 when in an N-th frame.

FIG. 9 is a schematic diagram illustrating the inversion pattern applied an N-th frame for the embodiment of FIG. 8.

Referring to FIG. 9, the display panel 100 according to the inventive concept includes a plurality of pixels which are arranged in the first direction D1 and the second direction D2 crossing the first direction D1. The pixels may include a red pixel, a green pixel and a blue pixel. Each of the pixels may be periodically disposed on the display panel 100.

The data lines and the common lines (not shown) are disposed alternately between the pixel columns. The data lines are extended in the second direction D2 that is a shorter side direction of the display panel 100 to be arranged in the first direction D1. The data lines are disposed in not every one pixel column but every two pixel columns. The common lines are disposed between the pixel columns in which the data lines are not disposed. The common lines are disposed in not every one pixel column but every two pixel columns. The common lines are extended in the second direction D2 that is a shorter side direction of the display panel 100 to be arranged in the first direction D1. The common lines may be paralleled with the data lines.

The (m+1)-th data line DLm+1 is connected with one of the pixels of a (k+1)-th column ('k' is a natural number) and one of the pixels of a (k+2)-th column in a j-th row ('j' is a natural number), a (j+1)-th row and a (j+2)-th row, and connected with one of the pixels of a k-th column and one of the pixels of a (k+1)-th column in a (j+3)-th row, a (j+4)-th row and a (j+5)-th row. In the present exemplary embodiment, a connecting structure of the (m+1)-th data line DLm+1 of a portion "C" is periodically repeated.

The data driving part (230 of FIG. 1) respectively applies data signals to a plurality of data lines formed on the display panel 100. For example, during an N-th frame, the data driving part 230 applies a data signal of a positive polarity (+) to an (m+1)-th data line DLm+1, and applies a data signal of a negative polarity (−) to an m-th data line DLm and an (m+2)-th data line DLm+2 adjacent to the (m+1)-th data line DLm+1, respectively.

Accordingly, a data voltage having different polarities such as in a sequence of "+, +, +, −, −, −" is applied to an odd-numbered column, and a data voltage having different polarities such as in a sequence of "+, +, +, +, +, +" or "−, −, −, −, −, −" is applied to an even-numbered row, and a data voltage having different polarities such as in a sequence of "+, +, −, −, +, +, −, −" is applied to an pixel row.

Figure 10:
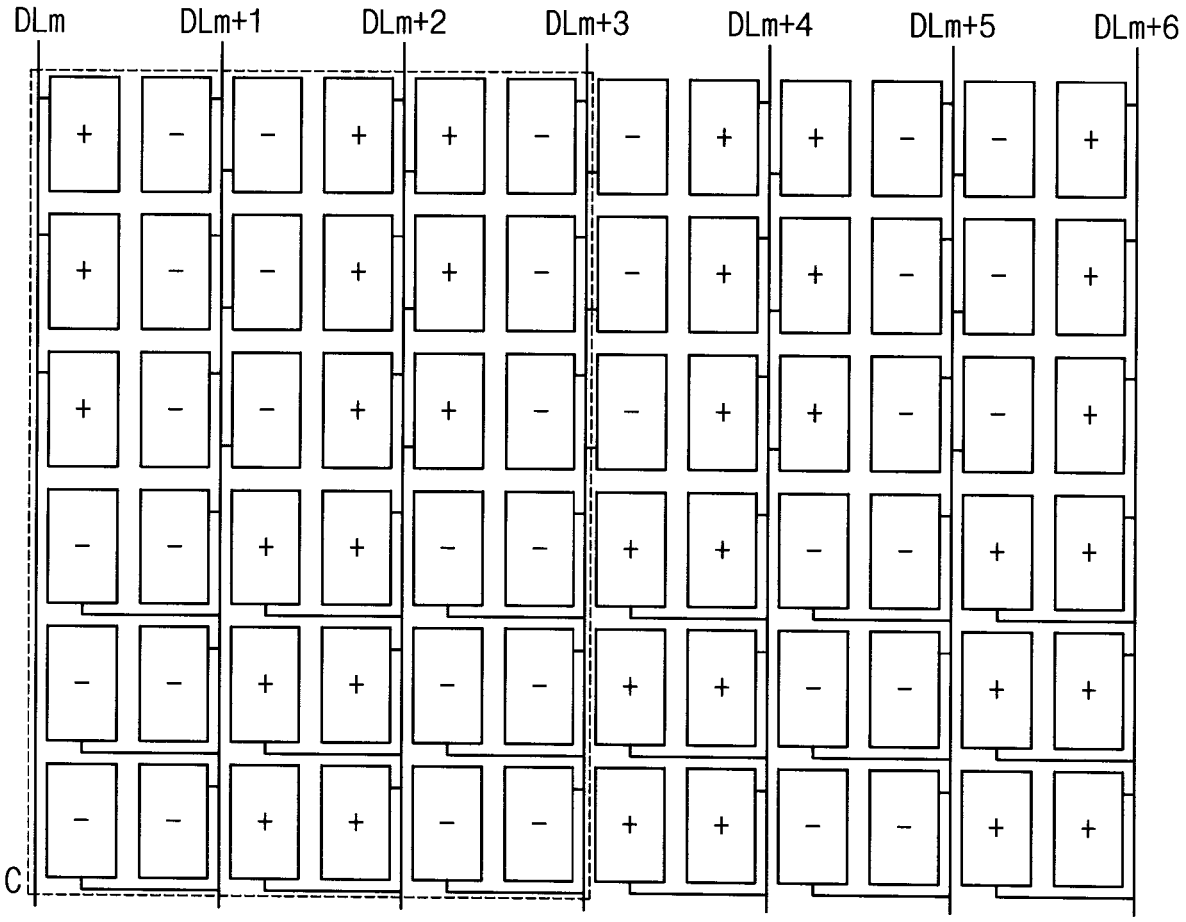
FIG. 10 is a schematic diagram illustrating the polarity inversion method of FIG. 9 but when in an (N+1) frame.

FIG. 10 is a schematic diagram illustrating the polarity inversion pattern for the display device of FIGS. 8-9 in an (N+1)-th frame.

Referring to FIG. 10, the display panel 100 according to the inventive concept includes a plurality of pixels which are arranged in the first direction D1 and the second direction D2 crossing the first direction D1. The pixels may include a red pixel, a green pixel and a blue pixel. Each of the pixels may be periodically disposed on the display panel 100.

The data lines and the common lines (not shown) are disposed alternately between the pixel columns. The data lines are extended in the second direction D2 that is a shorter side direction of the display panel 100 to be arranged in the first direction D1. The data lines are disposed in not every one pixel column but every two pixel columns. The common lines are disposed between the pixel columns in which the data lines are not disposed. The common lines are disposed in not every one pixel column but every two pixel columns. The common lines are extended in the second direction D2 that is a shorter side direction of the display panel 100 to be arranged in the first direction D1. The common lines may be paralleled with the data lines.

The (m+1)-th data line DLm+1 is connected with one of the pixels of a (k+1)-th column ('k' is a natural number) and one of the pixels of a (k+2)-th column in a j-th row ('j' is a natural number), a (j+1)-th row and a (j+2)-th row, and connected with one of the pixels of a k-th column and one of the pixels of a (k+1)-th column in a (j+3)-th row, a (j+4)-th row and a (j+5)-th row. In the present exemplary embodiment, a connecting structure of the (m+1)-th data line DLm+1 of a portion "C" is periodically repeated.

The data driving part (230 of FIG. 1) respectively applies data signals to a plurality of data lines formed on the display panel 100. For example, during an N-th frame, the data driving part 230 applies a data signal of a negative polarity (−) to an (m+1)-th data line DLm+1, and applies a data signal of a positive polarity (+) to an m-th data line DLm and an (m+2)-th data line DLm+2 adjacent to the (m+1)-th data line DLm+1, respectively.

Accordingly, a data voltage having different polarities such as in a sequence of "+, +, +, −, −, −" is applied to an odd-numbered column, and a data voltage having different polarities such as in a sequence of "+, +, +, +, +, +" or "−, −, −, −, −, −" is applied to an even-numbered row, and a data voltage having different polarities such as in a sequence of "+, +, −, −, +, +, −, −" is applied to an pixel row.

According to the present inventive concept(s) as explained above, although the data lines are arranged for the column inversion method, the ratio between number of data lines versus number of pixel columns is reduced to be less than 1-to-1 (<1:1) and thus area consumed for providing signal routing from the data lines driver to the pixels may be reduced. Additionally, the stretch length from the data line to the TFT in a spaced apart column is shortened by placing the cut-out corner closest to the signal supplying data line. Thus, an aperture ratio and a transmissivity may be increased.

In addition, since the display device is driven by a standard column inversion drive method and yet a pseudo-dot inversion pattern is obtained, the display device may have a low power consumption while providing a pseudo-dot inversion pattern.

The foregoing is illustrative of the present disclosure of invention and is not to be construed as limiting thereof. Although a few exemplary embodiments of the present teachings have been described, those skilled in the art will readily appreciate in view of the disclosure that many modifications are possible in the exemplary embodiments without materially departing from the novel teachings and advantages of the present teachings. Accordingly, all such modifications are intended to be included within the scope of the present teachings. In the claims, means-plus-function clauses are intended to cover the structures described herein as performing the recited function and not only structural equivalents but also equivalent structures.

What is claimed is:

1. A display device comprising:

a plurality of pixels arranged in a column direction and in a row direction;

a plurality of data lines, each of the plurality of data lines being directly connected with one pixel of a (k+1)-th column ('k' is a natural number) and one pixel of a (k+2)-th column to provide data signals and not directly connected with a pixel of a k-th column in a j-th row ('j' is a natural number) and a (j+1)-th row, and directly connected with one pixel of a k-th column and one pixel of a (k+1)-th column to provide data signals and not directly connected with a pixel of a (k+2)-th column in a (j+2)-th row and a (j+3)-th row; and a data driving part configured to apply data signals to the plurality of data lines, wherein the each of the plurality of data lines sequentially supplies data signals to the one pixel of the (k+1)-th column in the (j+1)-th row, the one pixel of the (k+2)-th column in the (j+1)-th row, the one pixel of the (k+1)-th column in the (j+2)-th row and the one pixel of the k-th column in the (j+2)-th row.

2. The display device of claim 1, wherein the data diving part is configured to apply a data signal having a first polarity to an (m+1)-th data line ('m' is a natural number), and to apply a data signal having an opposed second polarity to each of an m-th data line and an (m+2)-th data line adjacent to the (m+1)-th data line during one frame.

3. The display device of claim 1, further comprising:

a plurality of gate lines connected with the pixels, and wherein an n-th gate line ('n' is a natural number) is connected with one of the pixels of an odd-numbered column, and an (n+1)-th gate line is connected with one of the pixels of an even-numbered column.

4. The display device of claim 3, wherein a pair of the gate lines is disposed in between a corresponding pair of immediately adjacent pixel rows.

5. The display device of claim 4, further comprising a gate driving part configured to apply respective gate signals to respective ones of the gate lines.

6. The display device of claim 5, wherein the data driving part is disposed adjacent to a longer side of a display panel, and the gate driving part is disposed adjacent to a shorter side of the display panel.

7. The display device of claim 1, wherein the pixels comprise red, green and blue pixels arranged in a row direction.

8. A display device comprising:

a plurality of pixels arranged in a column direction and in a row direction;

a plurality of data lines, each of the plurality of data lines being directly connected with one pixel of a (k+1)-th column ('k' is a natural number) and one pixel of a (k+2)-th column to provide data signals and not directly connected with a pixel of a k-th column in a j-th row ('j' is a natural number), a (j+1)-th row and a (j+2)-th row, and directly connected with one pixel of a k-th column and one pixel of a (k+1)-th column to provide data signals and not connected with a pixel of a (k+2)-th column in a (j+3)-th row, a (j+4)-th row and a (j+5)-th row; and a data driving part configured to apply a-data signal to the plurality of data lines, wherein the each of the plurality of data lines sequentially supplies data signals to the one pixel of the (k+1)-th column in the (j+2)-th row, the one pixel of the (k+2)-th column in the (j+2)-th row, the one pixel of the (k+1)-th column in the (j+3)-th row and the one pixel of the k-th column in the (j+3)-th row.

9. The display device of claim 8, wherein the data diving part is configured to apply a data signal having a first polarity to an (m+1)-th data line ('m' is a natural number), and to apply a data signal having a second polarity to each of an m-th data line and an (m+2)-th data line adjacent to the (m+1)-th data line during one frame.

10. The display device of claim 8, further comprising:

a plurality of gate lines connected with the pixels, and wherein a n-th gate line ('n' is a natural number) is connected with one of the pixels of an odd-numbered column, and a (n+1)-th gate line is connected with one of the pixels of an even-numbered column.

11. The display device of claim 10, wherein a pair of the gate lines is disposed between a pair of immediately adjacent pixel rows.

12. The display device of claim 11, further comprising a gate driving part configured to apply respective gate signals to respective ones of the gate lines.

13. The display device of claim 12, wherein the data driving part is adjacent to a longer side of a display panel, and the gate driving part is adjacent to a shorter side of a display panel.

* * * * *